US008104398B2

(12) United States Patent
Bergmann

(10) Patent No.: US 8,104,398 B2
(45) Date of Patent: Jan. 31, 2012

(54) AXIAL PISTON MACHINE UTILIZING A SWASHPLATE DESIGN

(75) Inventor: Martin Bergmann, Schaafheim (DE)

(73) Assignee: Linde Material Handling GmbH, Achaffenburg (DE)

( * ) Notice: Subject to any disclaimer, the term of this patent is extended or adjusted under 35 U.S.C. 154(b) by 651 days.

(21) Appl. No.: 12/241,463

(22) Filed: Sep. 30, 2008

(65) Prior Publication Data

US 2009/0095150 A1 Apr. 16, 2009

(30) Foreign Application Priority Data

Oct. 15, 2007 (DE) ..... 10 2007 049 389

(51) Int. Cl.
*F04B 53/16* (2006.01)
*F04B 1/20* (2006.01)

(52) U.S. Cl. ..... 92/158; 92/57

(58) Field of Classification Search ..... 92/13, 57, 92/158

See application file for complete search history.

(56) References Cited

U.S. PATENT DOCUMENTS 3,153,987 A * 10/1964 Thoma ..... 92/57
3,216,333 A * 11/1965 Thoma ..... 92/110
6,321,635 B1 * 11/2001 Fujita ..... 92/71
6,324,959 B1 * 12/2001 Akasaka et al. ..... 92/57
6,422,129 B1 * 7/2002 Yokomachi et al. ..... 92/153

* cited by examiner

*Primary Examiner* — Thomas E Lazo
(74) *Attorney, Agent, or Firm* — The Webb Law Firm

(57) ABSTRACT

A hydrostatic axial piston machine utilizing a swashplate design has a cylinder drum (3) that is mounted so that it can rotate around an axis of rotation (2). The cylinder drum (3) is provided with cylinder bores (4), in each of which a piston (5) is mounted so that it can be displaced longitudinally. The pistons (5) are each supported on a swashplate (7) by a sliding element (6). Between the piston (5) and the cylinder bore (4), there is at least one annular groove (20; 20*a*, 20*b*) which is located in the area of the inner half ($L_{Fi}$) of the guided length ($L_F$), such as the minimum guided length ($L_F$) of the piston (5) in the cylinder bore (4).

4 Claims, 5 Drawing Sheets

AXIAL PISTON MACHINE UTILIZING A SWASHPLATE DESIGN

CROSS REFERENCE TO RELATED APPLICATION

This application claims priority to German application DE 10 2007 049 389.6, filed Oct. 15, 2007, which is herein incorporated by reference in its entirety.

BACKGROUND OF THE INVENTION

1. Field of the Invention

This invention relates to an axial piston machine utilizing a swashplate design. A cylinder drum is mounted so that it can rotate around an axis of rotation. The cylinder drum is provided with cylinder bores, in each of which a piston is mounted so that it can be displaced longitudinally. The pistons are each supported on a swashplate by a sliding element, such as a sliding shoe.

2. Technical Considerations

On hydrostatic axial piston machines in the form of swashplate machines, the pistons and the cylinder bore form a pressurized cylinder chamber. This results in a piston force which is directed along the longitudinal axis of the piston, which is supported on the swashplate by means of the sliding shoe. A transverse force which generates a torque around the axis of rotation of the axial piston machine is also exerted on a sliding shoe ball-and-socket joint between the piston and the sliding shoe.

On swashplate machines of this type, because the sliding shoe ball-and-socket joint between the piston and the sliding shoe is at a distance from the external support point of the piston in the cylinder bore in the longitudinal direction of the piston, a tipping moment is also applied to the piston. The tipping moment and the transverse force are thereby supported by a force couple that is exerted on the piston and formed by a swashplate-side support force and a cylinder-bore-side support force. The swashplate-side support force is thereby applied to the external support point of the piston in the cylinder bore and thus to the outer end of the guided length of the piston in the cylinder bore. The cylinder-bore-side support force is applied to the inner support point of the piston in the cylinder bore and, thus, on the inner end of the guided length of the piston in the cylinder bore. These support forces increase the friction between the piston and the cylinder bore. As a result of which, the efficiency of the swashplate machine is reduced.

As a result of the tipping moment which is applied to the piston, there is also a gap between the piston and the cylinder bore through which hydraulic fluid flows from the cylinder compartment into the casing. As a result of this gap flow, there is a hydrostatic force which is directed opposite to the transverse force and is applied to the piston in the center of the guided length of the piston in the cylinder bore.

This hydrostatic force simultaneously reduces the swashplate-side support force and increases the cylinder-bore side support force. However, on account of the hydrostatic force that originates from the gap flow, and in particular the resulting increase in the cylinder-bore-side support force, the friction of the axial piston machine is increased, which adversely affects the efficiency of the swashplate machine. The wear to the inner, cylinder-compartment-side end surface of the piston also increases because it is the point at which the cylinder-bore-side support force is applied.

Therefore, it is an object of the invention to provide a hydrostatic axial piston machine of the general type described above which has improved efficiency and reduced wear.

SUMMARY OF THE INVENTION

The invention teaches that between the piston and the cylinder bore there is at least one annular groove which is located in the area of the inner half of the guided length, in particular of the minimum guided length of the piston in the cylinder bore. Therefore, no hydrostatic force occurs in the area of the annular groove, which means that the hydrostatic force accumulates only in the outer half of the guided length. Compared to the swashplate machine of the known art, the hydrostatic force is therefore quantitatively lower and the point of application is displaced from the middle of the guided surface into the outer half of the guided surface. Consequently, on a swashplate machine of the invention compared to a swashplate machine of the known art, the swashplate-side support force is reduced to a lesser extent and the cylinder-bore-side support force is increased to a lesser extent. Overall, the sum of the support forces in the presence of a hydrostatic force is less than the sum of the support forces without a hydrostatic force. In total, therefore, when a hydrostatic force is present and thus a flow through the gap, lower support forces and thus reduced friction between the piston and the cylinder bore are achieved, which result in an improved efficiency of the swashplate machine. In addition, as a result of the lower additional load of the cylinder-bore-side support force by the hydrostatic force, the inner, cylinder-compartment-side end surface of the piston is exposed to lower loads. As a result of which, there is reduced wear, which means that a less wear-resistant and thus more economical material pair can be used for the piston and the cylinder bore.

In one embodiment of the invention, the at least one annular groove is provided on the piston. An annular groove or a plurality of annular grooves can easily be machined into the piston.

In an additional embodiment of the invention, the at least one annular groove is provided in the cylinder bore. The stability of the piston is not adversely affected by the realization of the annular groove or annular grooves in the cylinder bore.

In one embodiment of the invention, the at least one annular groove is located in the area of from 0.15 to 0.5 times the guided length, in particular of the minimum guided length, of the piston in the cylinder bore, viewed from the inner end of the guided length. When the annular groove or grooves are located in this position in the inner half of the guided length of the piston in the cylinder bore, the result is the maximum friction-reducing effect of the hydrostatic force resulting from the gap flow.

The annular groove can thereby extend over all of the above-mentioned guided length or only part of the above-mentioned guided length.

If the inner edge of the at least one annular groove is located in the area of 0.15 times the guided length, in particular of the minimum guided length viewed from the inner end of the guided length and the outer edge of the at least one annular groove is located in the area of 0.5 times the minimum guided length, viewed from the inner end of the guided length, the invention teaches that it is easily possible to ensure that no hydrostatic force is generated on the inner half of the minimum guided surface in the area from 0.15 times to 0.5 times the minimum guided surface from the gap flow, and that a sufficient area is available on the piston to absorb the cylinder-bore-side support force on the cylinder-bore-side end up to 0.15 times the guided length, in particular of the minimum guided length.

Additional advantages and details of the invention are explained in greater detail below with reference to the exemplary embodiments illustrated in the accompanying schematic drawings, wherein like reference numbers identify like parts throughout.

DESCRIPTION OF THE PREFERRED EMBODIMENTS

Figure 1:
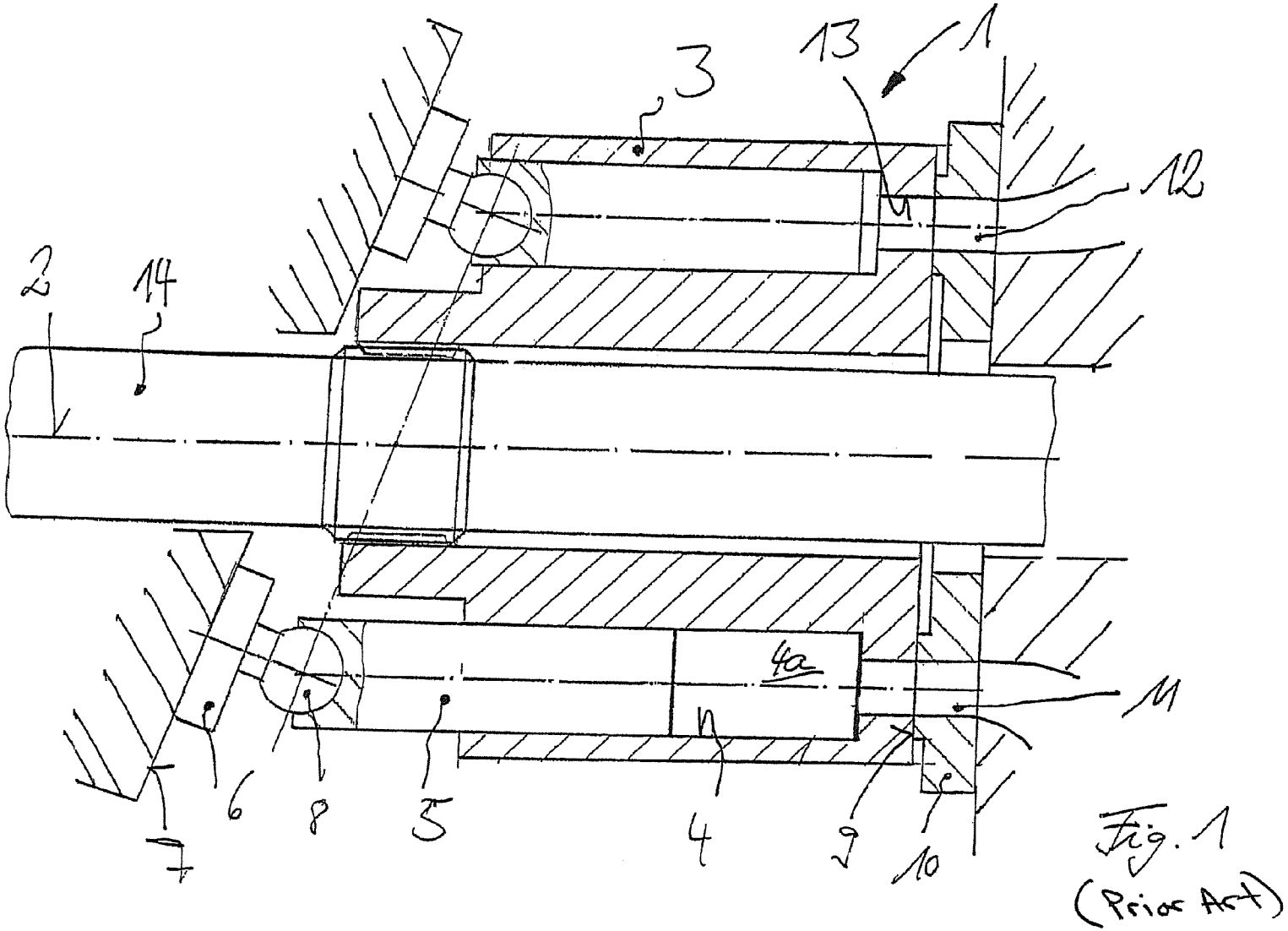
Fig. 1 (Prior Art)
FIG. 1 shows a swashplate machine of the known art in longitudinal section.

FIG. 1 shows, in longitudinal section, an axial piston machine of the known art realized in the form of a swashplate machine 1.

The swashplate machine 1 has a cylinder drum 3 that is mounted so it can rotate around an axis of rotation 2 and is provided with a plurality of concentrically arranged cylinder bores 4, in each of which a piston 5 is mounted so that it can be displaced longitudinally. The cylinder drum 3 is thereby non-rotationally connected with a drive shaft 14 which is concentric with the axis of rotation 2.

The pistons 5 are thereby each supported on a swashplate 7 by means of a sliding element 6 which is realized in the form of a sliding shoe. For this purpose, a sliding shoe ball-and-socket joint 8 is realized between the piston 5 and the sliding element 6. The swashplate 7 can be molded onto a casing indicated by the hatched areas, whereby the swashplate machine 1 has a fixed displacement volume. It is also possible, however, to realize the swashplate 7 so that it can be adjusted, as a result of which the swashplate machine 1 has a variable displacement volume.

The cylinder drum 3 is supported in the axial direction on a control surface 9 which is in one piece with the casing and which is realized on a disc-shaped control plate 10. The control plate 10 is provided with kidney-shaped control slots 11, 12 which form an inlet connection and an outlet connection of the swashplate machine 1. The cylinder drum 3 is provided with a connecting channel 13 for each cylinder bore 4, whereby during a rotation of the cylinder drum 3 around the axis of rotation 2, the connecting channel 13 establishes a connection between the cylinder compartment 4*a* formed by the cylinder bore 4 and the piston 5 with the control slots 11, 12 and thus with the inlet connection and the outlet connection.

Figure 2:
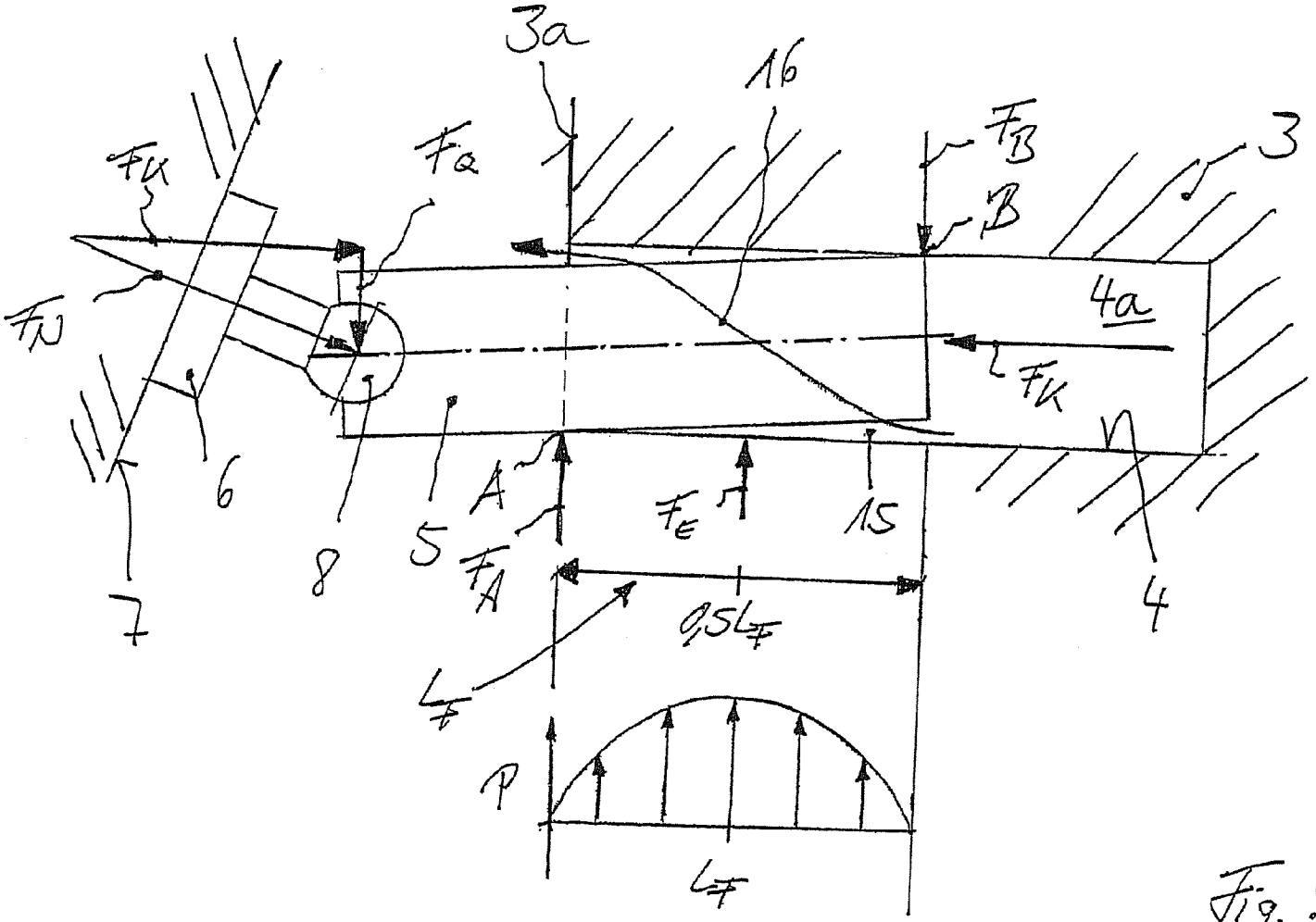
Fig. 2 (Prior Art)
FIG. 2 is an enlarged detail from FIG. 1.

FIG. 2 shows the piston 5 at top dead center at the maximum piston stroke. The piston 5 is thereby acted upon on the cylinder-compartment-side end surface, on the right in FIG. 2, by the pressure in the cylinder compartment 4*a* and a resulting piston force $F_K$ that is oriented along the longitudinal axis of the piston. This piston force is supported by means of the sliding element 6 on the swashplate 7, which is oriented at an angle with respect to the longitudinal axis of the piston, by a diagonally directed support force FN. As a result of this support force, there is a transverse force $F_Q$ which is applied to the sliding shoe ball-and-socket joint 8, which generates a torque on the drive shaft 14 via the cylinder drum 3.

The sliding shoe ball-and-socket joint 8 is thereby at a distance, due to its design, from the outer support point A of the piston 5 in the cylinder bore 4 in the longitudinal direction of the piston 5. As a result of which the transverse force $F_Q$ generates a tipping moment that acts on the piston 5, which tilts the piston 5 with the piston longitudinal axis and into the diagonal position illustrated in FIG. 2.

The transverse force $F_Q$ and the tipping moment are supported on the piston 5 by a force couple that consists of a swashplate-side support force $F_A$ and a cylinder-bore-side support force $F_B$. The swashplate-side support force $F_A$ is thereby applied to the outer support point A of the piston 5 in the cylinder bore 4 and thus to the outer end of the guided length $L_F$ of the piston 5 in the cylinder bore 4. In the illustrated position of the piston 5, the outer support point A is on the end surface 3*a* of the cylinder drum facing the swashplate 7, so that the swashplate-side support force $F_A$ is applied to the end surface 3*a* of the cylinder drum 3 facing the swashplate 7. If the piston 5 is provided with a flange in the area of the sliding shoe ball-and-socket joint 8, a tipping moment is also exerted on the piston 5 at the minimum piston stroke in the area of bottom dead center on account of the axial distance of the outer support point A that is now inside the cylinder bore 4 and of the sliding shoe ball-and-socket joint 8. The cylinder-bore side support force $F_B$ is applied to the inner support point B of the piston 5 in the cylinder bore 4 and thus on the inner end of the guided length $L_F$ of the piston 5 in the cylinder bore 4. In FIG. 2, the piston 5 is at the maximum piston stroke and thus has the minimum guided length $L_F$ inside the cylinder bore 4. The guided length $L_F$ of the piston 5 in the cylinder bore 4 thereby extends from the outer support point A, which is, for example, on the end surface 3*a* of the cylinder drum 3, to the inner support point B, which is on the cylinder compartment-side end surface of the piston 5, whereby the support point A represents the outer end of the guided length $L_F$ and the support point B the inner end of the guided length $L_F$.

On account of the tipping moment and the resulting inclined position of the piston 5, a gap 15 is also formed between the piston 5 and the cylinder bore 4, via which hydraulic fluid flows from the cylinder compartment 4 into the casing.

As indicated by the arrow 16 in FIG. 2, the hydraulic fluid thereby flows from the cylinder compartment 4*a* into the gap 15 which narrows between the piston 5 and the cylinder bore 4, flows around the piston 5 in the radial direction and flows via the gap 15, which widens again, into the casing. The pressure of the flow of hydraulic fluid through the gap 15 is thereby not constant over the periphery of the piston. The pressure profile P over the guided length $L_F$ that results from the integration of the pressure forces that act in the peripheral direction is thereby illustrated as an additional diagram in FIG. 2. This symmetrical pressure profile, which extends over the entire guided surface $L_F$ of the piston 5, with an integration of all the pressure forces, results in a hydrostatic force $F_E$, which is directed opposite to the transverse force $F_Q$ and is applied in the center of the guided length $L_F$ between the piston 5 and the cylinder bore 4.

This hydrostatic force $F_E$ reduces the swashplate-side support force $F_A$ and increases the cylinder-bore-side support force $F_B$ to the same extent. The sum of the support forces $F_A$ and $F_B$ and thus the resulting friction forces is therefore constant under operating conditions with hydrostatic force $F_E$ and under operating conditions without a hydrostatic force $F_E$. The strong friction forces created by the strong support forces $F_A$ and $F_B$ reduce the efficiency of a swashplate machine 1 of the prior art.

The increase of the cylinder-bore-side support force $F_B$ caused by the hydrostatic force $F_E$ results in an increased load on the cylinder-compartment-side end surface of the piston 5, shown on the right in FIG. 2, and thus in greater wear of the piston 5.

Figure 3:
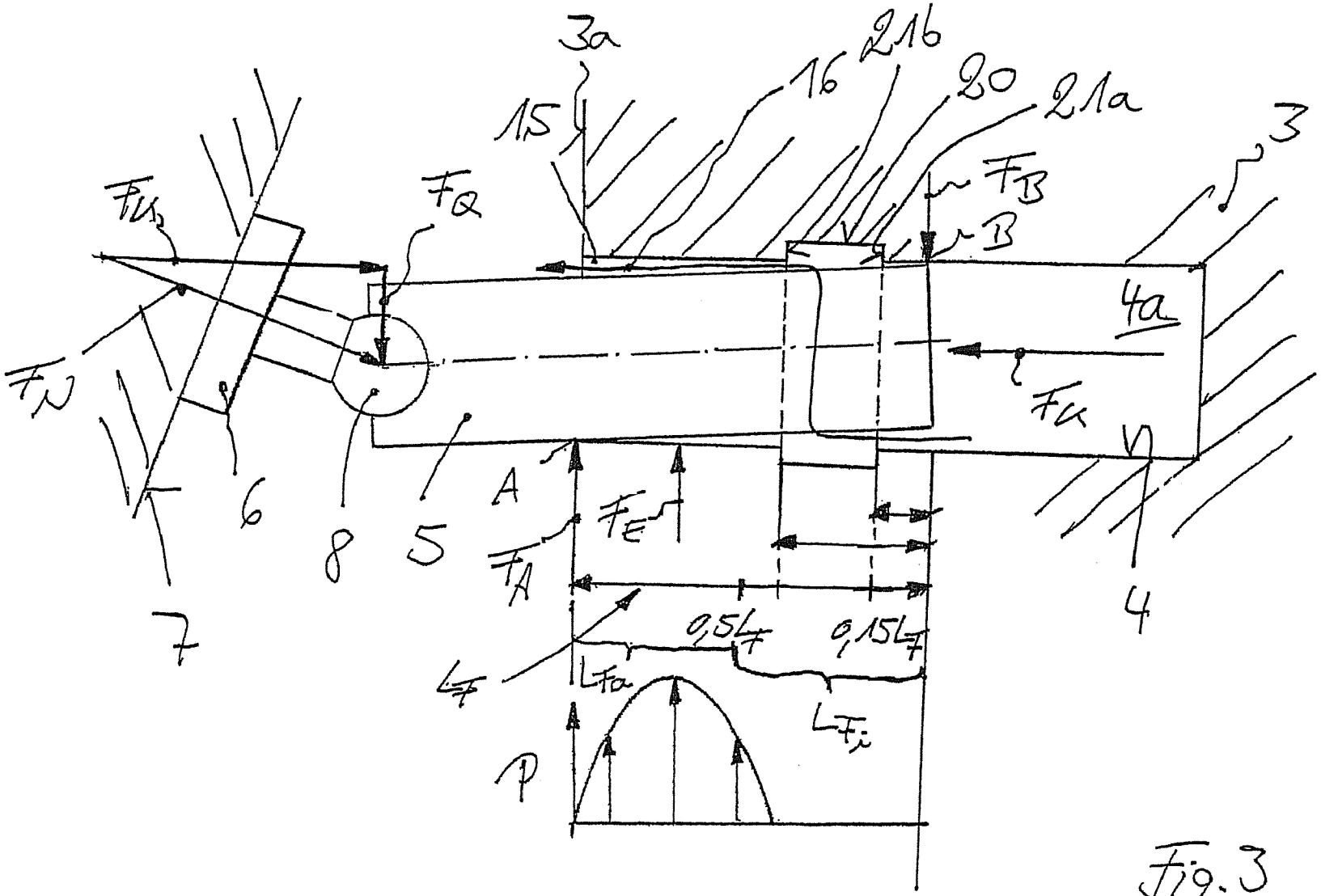
FIG. 3 shows a first embodiment of a swashplate machine of the invention in a view like the one in FIG. 2.

The invention teaches that (as illustrated in FIG. 3) between the piston 5 and the cylinder bore 4 there is at least one annular groove 20, which is located in the area of the inner half $L_{Fi}$ of the minimum guided length $L_F$ of the piston 5 in the cylinder bore 4. As shown in FIG. 3, the annular groove 20 is located in the area of 0.15 times the minimum guided length $L_F$ viewed from the inner end of the guided length $L_F$. The outer edge 21*b* of the annular groove 20 is located in the area of 0.5 times the minimum guided length $L_F$ seen from the inner end of the guided length $L_F$.

The annular groove 20 is therefore located in the area of the inner half $L_{Fi}$ of the guided length $L_F$ in the area of 0.15 times to 0.5 times the minimum guided length $L_F$ of the piston 5 in the cylinder bore 4, and extends over essentially this entire area of the guided length $L_F$.

As a result of the presence of this annular groove 20, the hydraulic fluid that flows from the cylinder compartment 4*a* through the gap 15 into the casing in the area of the annular groove 20, on account of the large height of the gap achieved by the annular groove 20, can flow around the piston 5 between the piston 5 and the cylinder bore 4 with practically no loss of pressure. As a result of which, the same pressure is realized over the periphery of the piston 5 and therefore, after the integration of the pressure forces over the periphery of the piston, no hydrostatic forces are active in the area of the annular groove 20 between the piston 5 and the cylinder bore 4. With the integration of the pressure forces over the periphery of the piston, the pressure profile P illustrated in the graphic in FIG. 3 is realized, which extends essentially only over the outer half $L_{Fa}$ of the guided surface $L_F$.

The hydrostatic force $F_E$ that results from the pressure profile P is thereby quantitatively less than the hydrostatic force $F_E$ in a swashplate machine 1 of the known art, and the point of application of the hydrostatic force $F_E$ is no longer in the center of the guided length $L_F$ (as in a swashplate machine of the known art) but is displaced into the outer half $L_{Fa}$ of the guided length $L_F$ to the end surface 3*a* of the cylinder drum 3 illustrated on the left in FIG. 3. On account of this point of application and the magnitude of the hydrostatic force $F_E$, on a swashplate machine 1 of the invention compared to a swashplate machine 1 of the known art, the swashplate-side support force $F_A$ is reduced to a lesser extent and the cylinder-bore-side support force $F_B$ is increased to a lesser extent.

The sum of the two support forces $F_A$ and $F_B$ when a hydrostatic force $F_E$ is applied is therefore less than under operating conditions where there is no hydrostatic force $F_E$. As a result of the hydrostatic force $F_E$ that originates from the gap flow via the annular groove 20 of the invention, a reduction of the support forces $F_A$ and $F_B$ and of the friction forces resulting from the support forces $F_A$ and $F_B$ is achieved, which improves the efficiency of the swashplate machine of the invention. In addition, as a result of the slight increase of the cylinder-bore-side support force $F_B$, the load on the end surface of the piston 5 is reduced. As a result of which, less wear occurs and a less wear-resistant and economical material pair can be used for the piston 5 and the cylinder bore 4.

In the exemplary embodiment illustrated in FIG. 3, the annular groove 20 extends almost completely from 0.15 times to 0.5 times the minimum guided length $L_F$ viewed from the inner end of the guided length $L_F$.

Figure 4:
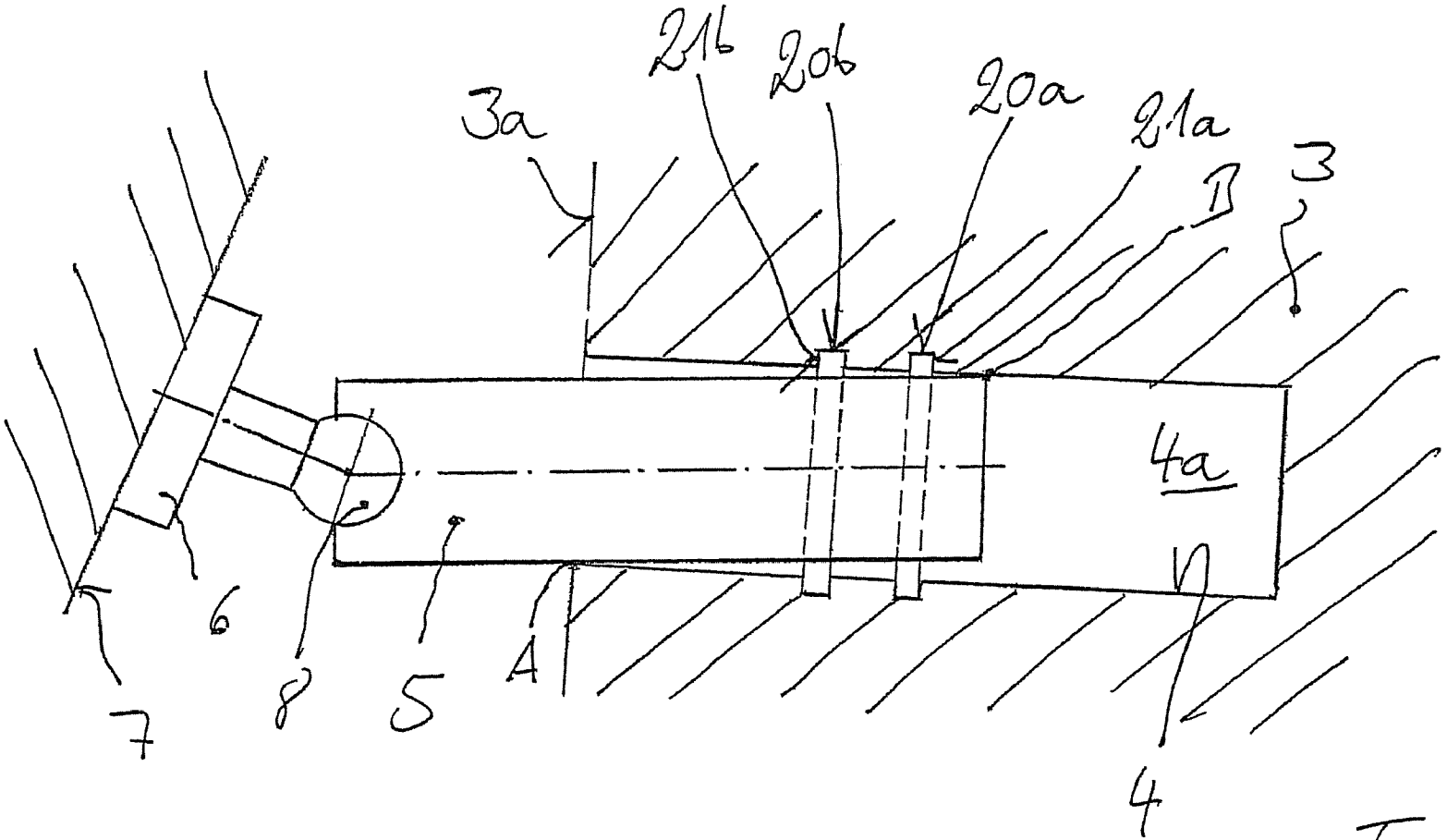
FIG. 4 shows a second embodiment of a swashplate machine of the invention in a view like the one in FIG. 2.

It is also possible, however, as illustrated in FIG. 4, to locate a plurality of annular grooves, e.g., two grooves 20*a* and 20*b*, in this area of the inner half of the $L_{Fi}$ of the guided length $L_F$. The inner edge 21*a* of the inner annular grooves 20*a*, like the inner edge 21*a* of the annular groove 20 in FIG. 3, is thereby located in the area of 0.15 times the minimum guided length $L_F$ viewed from the inner end of the guided length $L_F$. Likewise, the outer edge 21*b* of the outer annular groove 20*b*, analogous to the outer edge 21*b* of the annular groove in FIG. 3, is located in the area of 0.5 times the minimum guided length $L_F$.

Figure 5:
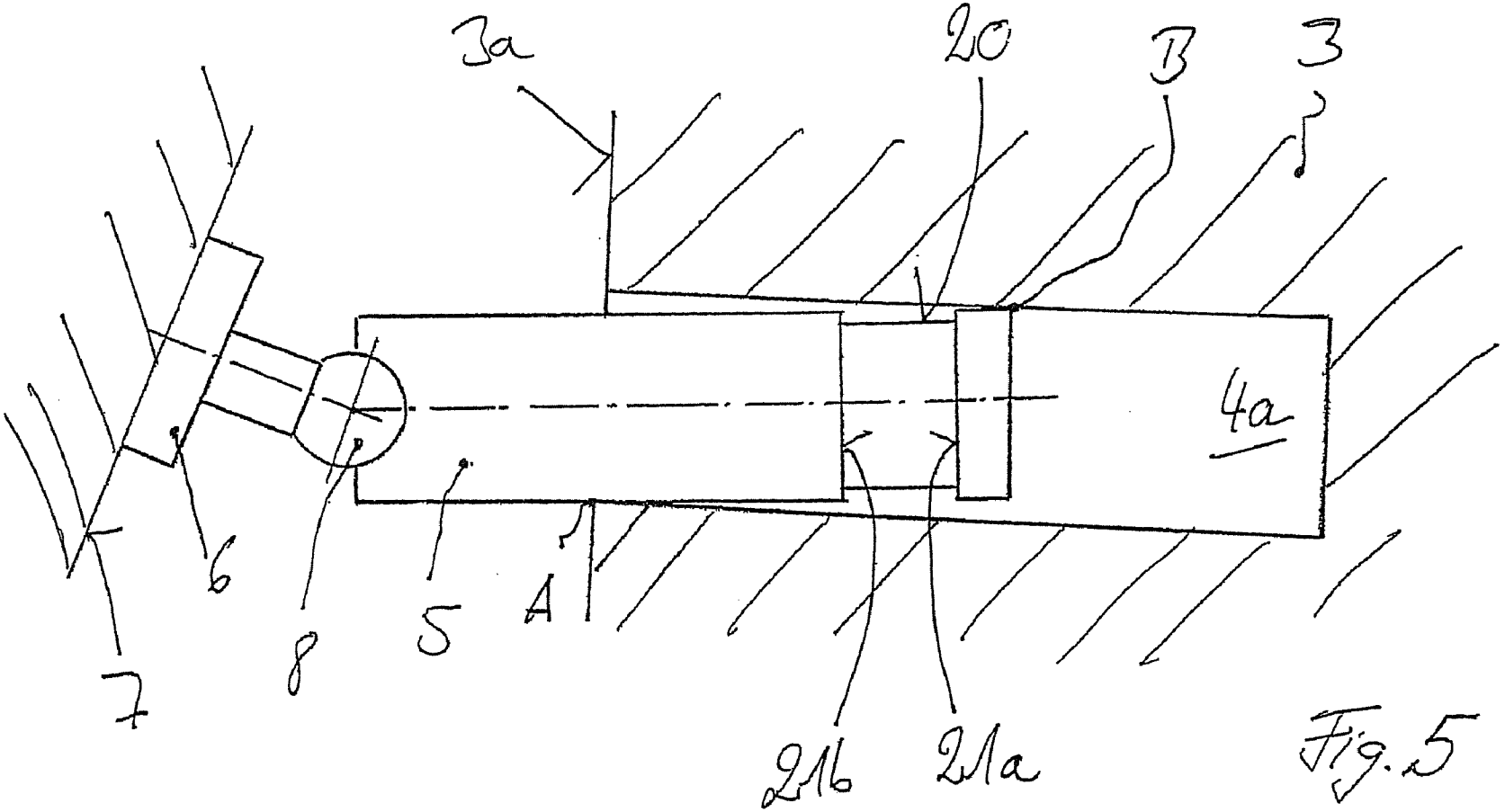
FIG. 5 shows a third embodiment of a swashplate machine of the invention in a view like the one in FIG. 2.

As shown in FIG. 5, an annular groove 20 or a plurality of annual grooves can be located on the piston 5, whereby the location of the inner edge 21*a* and of the outer edge 21*b* with reference to the guided length $L_F$ is the same to the exemplary embodiments illustrated in FIGS. 3 and 4.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic axial piston machine, comprising:

a cylinder drum rotatable around an axis of rotation, wherein the cylinder drum is provided with cylinder bores; and a piston mounted in each cylinder bore and disposable longitudinally;

wherein the pistons are each supported on a swashplate by a sliding element, wherein between each piston and associated cylinder bore at least one annular groove is provided which is located in an area of an inner half of a minimum guided length of the piston in the cylinder bore, wherein the at least one annular groove is provided on the cylinder bore, and wherein the at least one annular groove is located in an area from 0.15 times to 0.5 times the minimum guided length of the piston in the cylinder bore viewed from the inner end of the guided length.

2. The hydrostatic axial piston machine as recited in claim 1, wherein an inner edge of the at least one annular groove is located in the area of 0.15 times the minimum guided length, viewed from the inner end of the guided length.

3. The hydrostatic axial piston machine as recited in claim 2, wherein an outer edge of the at least one annular groove is located in the area of 0.5 times the minimum guided length, viewed from the inner end of the guided length.

4. The hydrostatic axial piston machine as recited in claim 1, wherein an outer edge of the at least one annular groove is located in the area of 0.5 times the minimum guided length, viewed from the inner end of the guided length.

* * * * *

UNITED STATES PATENT AND TRADEMARK OFFICE

CERTIFICATE OF CORRECTION

PATENT NO. : 8,104,398 B2
APPLICATION NO. : 12/241463
DATED : January 31, 2012
INVENTOR(S) : Martin Bergmann It is certified that error appears in the above-identified patent and that said Letters Patent is hereby corrected as shown below:

Face of Patent, Column 1, Item (73) Assignee, Line 2, delete "Achaffenburg" and insert -- Aschaffenburg --

Signed and Sealed this
Tenth Day of April, 2012

David J. Kappos

David J. Kappos
*Director of the United States Patent and Trademark Office*